United States Patent [19]

Bergin et al.

[11] Patent Number: 5,018,992

[45] Date of Patent: May 28, 1991

[54] WEDGE LAMP AND CLIP

[75] Inventors: John A. Bergin, Hancock; Roger A. Racette, Hillsboro, both of N.H.

[73] Assignee: GTE Products Corporation, Danvers, Mass.

[21] Appl. No.: 197,014

[22] Filed: May 20, 1988

[51] Int. Cl.[5] ..... H01R 33/09

[52] U.S. Cl. ..... 439/699; 313/318

[58] Field of Search ..... 439/619, 699, 611, 612; 313/318

[56] References Cited

U.S. PATENT DOCUMENTS

| | | | |
|---|---|---|---|
| 1,721,207 | 7/1929 | Cunningham | 439/458 |
| 2,937,308 | 5/1960 | Howles et al. | 313/315 |
| 3,573,534 | 8/1971 | Leighton | 313/318 |
| 3,783,437 | 1/1974 | Graff et al. | 439/619 |
| 3,936,131 | 2/1976 | Durand | 439/699 |
| 3,986,068 | 10/1976 | Albrecht | 313/318 |
| 4,052,638 | 10/1977 | Love et al. | 313/318 |
| 4,074,929 | 2/1978 | Krider | 439/676 |
| 4,114,972 | 9/1978 | Kraus et al. | 439/375 |
| 4,152,622 | 5/1979 | Fitzgerald | 313/318 |
| 4,181,390 | 1/1980 | Aizawa | 439/375 |
| 4,316,240 | 2/1982 | Pitkjaan et al. | 362/267 |
| 4,318,158 | 3/1982 | Livermore et al. | 362/29 |
| 4,365,396 | 12/1982 | Baba et al. | 439/699 |
| 4,418,973 | 12/1983 | Smetana | 439/699 |
| 4,468,585 | 8/1984 | Beyland et al. | 313/318 |
| 4,473,770 | 9/1984 | Baba et al. | 313/318 |
| 4,593,958 | 6/1986 | Baba | 439/699 |
| 4,595,859 | 6/1986 | Steiner et al. | 313/318 |
| 4,603,278 | 7/1986 | Devir et al. | 313/318 |
| 4,631,651 | 12/1986 | Bergin et al. | 362/267 |
| 4,724,353 | 2/1988 | Devir | 313/318 |

FOREIGN PATENT DOCUMENTS

| | | | |
|---|---|---|---|
| 3020309 | 12/1981 | Fed. Rep. of Germany | 313/318 |
| 1475752 | 9/1969 | France . | |

*Primary Examiner*—Neil Abrams

*Attorney, Agent, or Firm*—William E. Meyer

[57] ABSTRACT

A wedge lamp and clip having exterior means for making electric connections to a lamp lead, and having pinning means for securely locating the lamp and clip in a base are described. By bringing the lamp lead out and folding it back over the lamp clip, the clip may directly and securely mate to the envelope extension, and multiple secure electrical and mechanical contacts may be made between the clip and the lamp lead. By making the clip conductive, the electric connection need not be made directly to the lamp lead, but may be made indirectly through the conductive clip. Mechanical stress between the lamp envelope and any support may also be mediated by the clip.

18 Claims, 2 Drawing Sheets

WEDGE LAMP AND CLIP

TECHNICAL FIELD

The invention relates to the coupling of electric lamps to lamp bases and particularly to electric lamps known as wedge lamps. More particularly the invention is concerned with a clip acting between a lamp envelope and a lamp base providing secure mechanical and electrical connection of the envelope and a base.

BACKGROUND ART

Wedge lamps are small, easily assembled and installed lamps popularly used in the automobile and electronics markets. Individually, wedge lamps are necessarily inexpensive, but nonetheless must meet the needs of quick, reliable insertion into a larger assembly, and must be durable in the environment of use. The common methods of wedge lamp manufacture rely on a frictional compression of the lamp lead by an exterior clip, base or combination of the two.

Numerous patents concerning the anchoring and electrical connection to wedge lamps have been granted The following patents generally demonstrate the teachings made by others. U.S. Pat. No. 2,937,308 to Howles et. al. shows a wedge lamp with the leads folded against the envelope extension. Howles is a typical example of the prior art to be improved on. U.S. Pat. No. 3,936,131 to Durand shows a wedge lamp with a clip. The leads are positioned between the clip and the envelope extension. U.S. Pat. No. 4,052,638 to Love et. al. shows a wedge lamp with the leads looped back over the envelope extension Love also shows an example of prior art to be improved on. U.S. Pat. Nos. 4,365,396; 4,473,770; and 4,593,958 to Baba et. al. show wedge lamps with conductive clips positioned over the envelope extension, and enclosing the leads between the envelope and the clip. No adequate weld, or multiple attachments may be conveniently made to the enclosed lead. U.S. Pat. No. 4,603,278 to Devir et. al. shows a wedge lamp with the leads folded up in a nonconductive slot. Electrical connection is limited to direct contact with the lead. U.S. Pat. No. 4,468,585 to Beyland et. al. shows a wedge lamp with leads wrapped around posts of a nonconductive material. U.S. Pat. No. 4,418,973 to Smetana et al shows a wedge lamp with leads enclosed by clips, and having contact arms insertable in a base. U.S. Pat. No. 4,318,158 to Livermore et. al. shows a wedge lamp with leads enclosed by a clip.

Unfortunately, a frictional linkage, as where a clip frictionally pins a lamp lead, can fail after time, particularly in an automobile where the bouncing of the car shakes the envelope free of the base. As a result, the electrical connection can become intermittent, and may even fail. Other methods of fixing the lamp to the base are possible, as for example, cementing, or screw mounting, but these methods are not cost competitive, especially in small lamps individually costing very little. A need then exists for a method of inexpensively linking a small lamp envelope to a base or other support that is mechanically and electrically durable, particularly in environments that shake or vibrate.

DISCLOSURE OF THE INVENTION

An electrically conductive clip for positioning a lamp envelope with respect to a support and electrically connecting an electrical lead extending from the lamp envelope may be made wherein the clip includes an electrically conductive housing having interior coupling means coacting with the lamp envelope for fixedly positioning the clip with respect to the envelope, means for mechanically coupling a length of the electrical lead to the exterior of the clip, means for electrically connecting the lead to the clip, and means for electrically connecting the clip to an electric source.

BEST MODE FOR CARRYING OUT THE INVENTION

Figure 1:
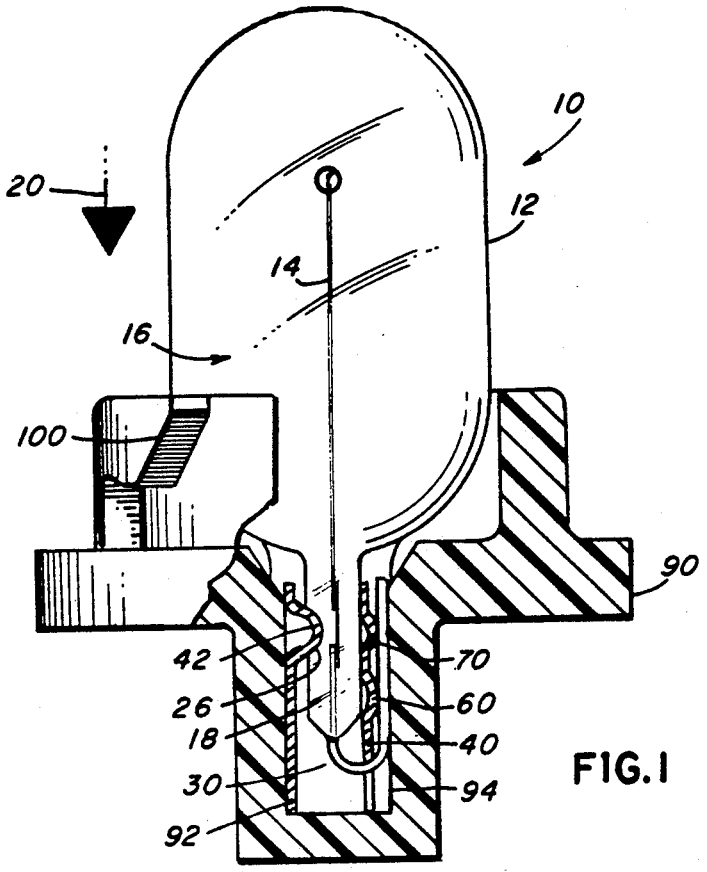
FIG. 1 shows a side view, partially cut away, of a Preferred embodiment of a wedge lamp and clip positioned in a base.

FIG. 1 shows a side view partially cut away of a preferred embodiment of a wedge lamp 10 and clip positioned in a base. The lamp 10 includes an electric lighting means having a light transmissive envelope 12 enclosing an internal lighting mechanism, such as a tungsten filament 14 in a halogen and gas, gas or vacuum environment 16. The envelope 12 includes a formed extension 18, so the envelope 12 may be mechanically attached to a base 90 for final positioning and electrical connection. The envelope extension 18 shown is typical of the press seal portion of a tungsten halogen or wedge base lamp. For reference, the direction away from the envelope 12 along the extension 18 is referred to as the insertion direction 20, and the opposite direction is the withdrawal direction.

The envelope extension 18 includes either a protrusion, an indentation or other surface feature to create an attachment point. An indentation 26 is shown as an attachment point. A second surface, at least partially complementary the the attachment point, may then mate with the envelope extension 18 and be trapped in close fitting engagement, at least in the insertion and withdrawal directions. The attachment point transmits mechanical forces on the envelope 12 to the close fitting and trapped attachment. Numerous attachment formations are known in the art and many of these are felt to be adequate for use here. For example, the indentation 26 may be replaced with a protrusion, with a corresponding hole or indentation fashioned in the clip for close fitting attachment.

Exiting from the envelope 12 through the formed envelope extension 18 is an electrical lead 30. Electrical leads, such as lead 30, are commonly made of dumet or molybdenum and are capable of being bent, wrapped, soldered or welded for electrical connection. The lead 30 initially extends away from the envelope 12 in the insertion direction 20, but during assembly a portion of the lead's length may be folded back in the withdrawal direction.

Figure 3:
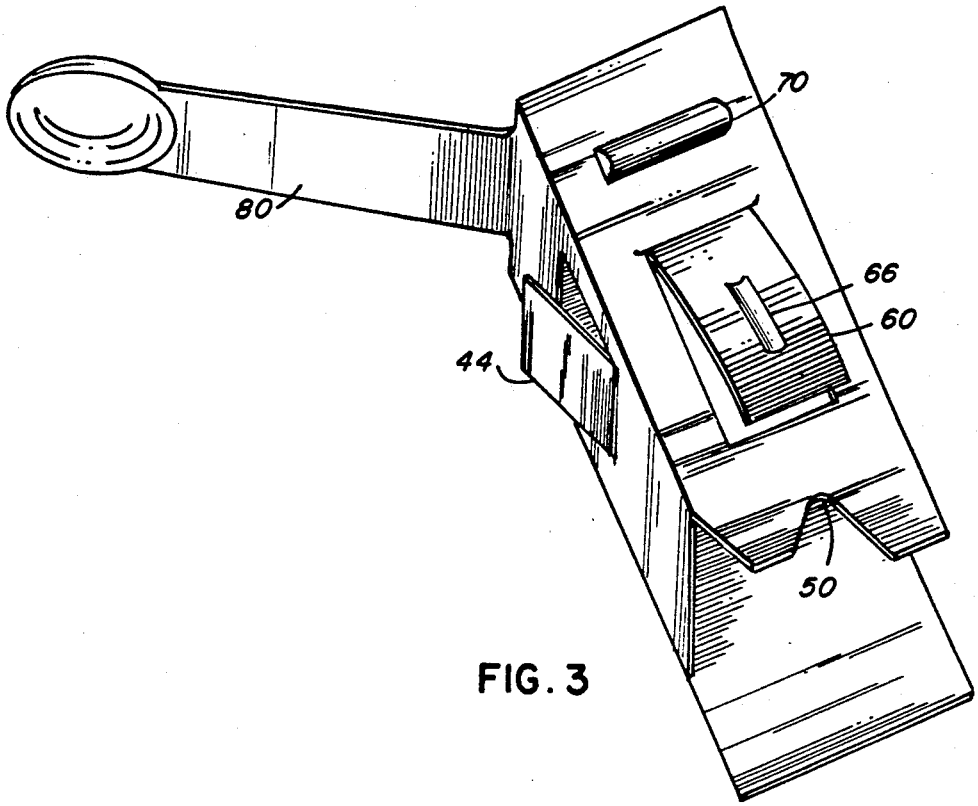
FIG. 3 shows a first perspective view of a preferred embodiment of a clip.
Figure 4:
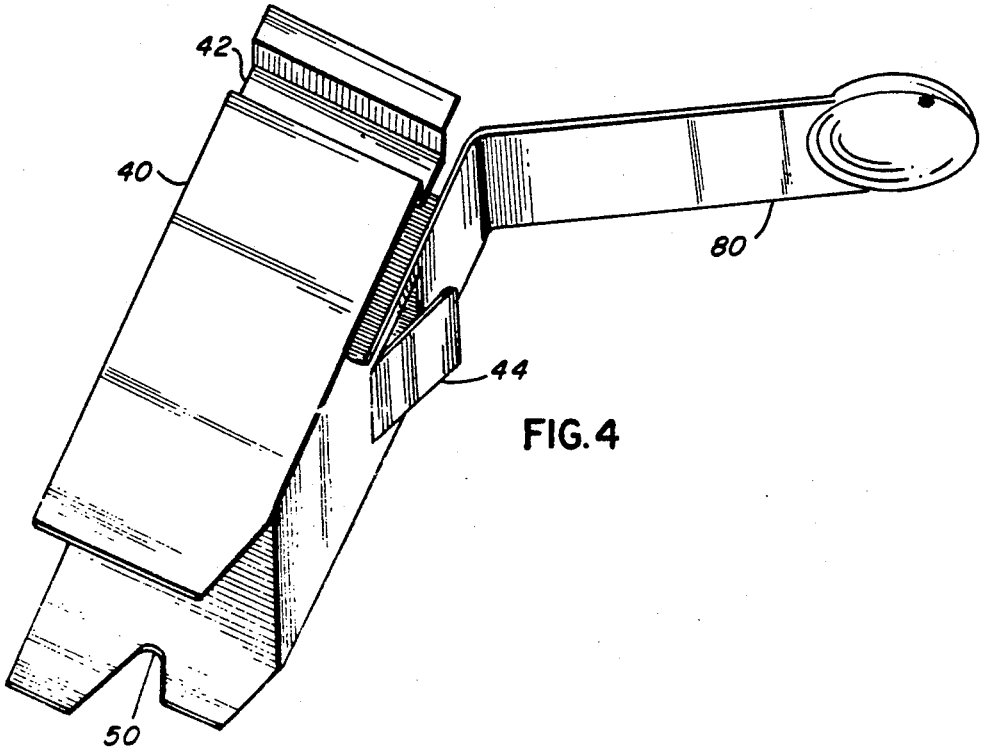
FIG. 4 shows a second perspective view of a preferred embodiment of a clip.
Figure 1:
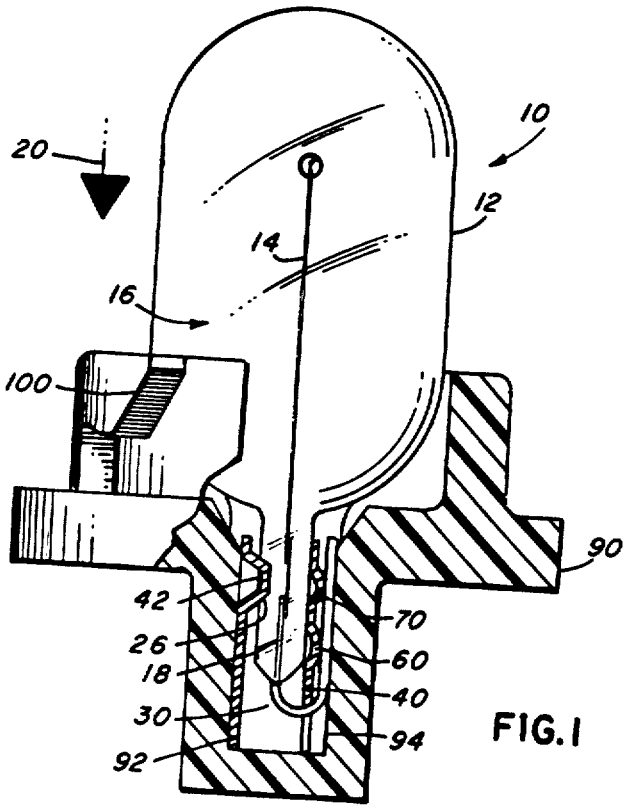
Figure 2:
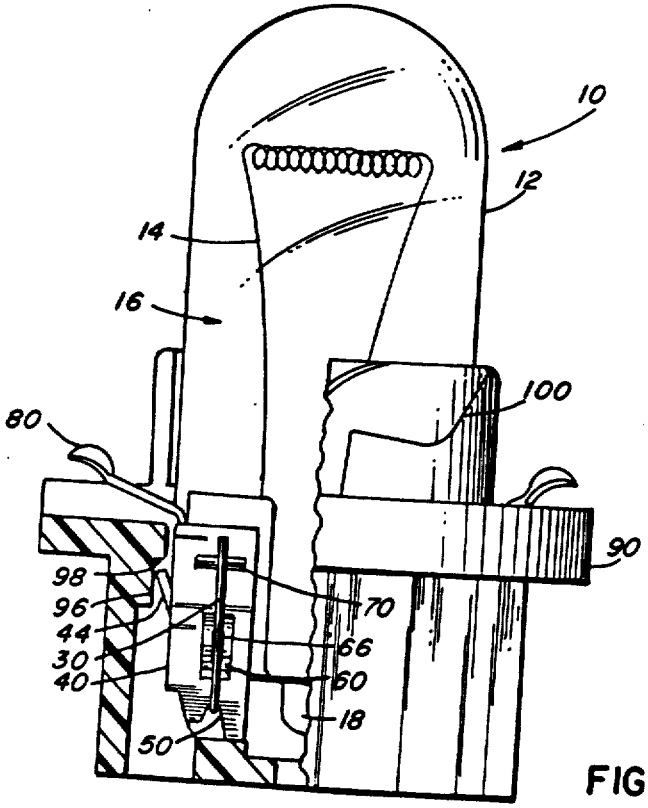
Figure 3:
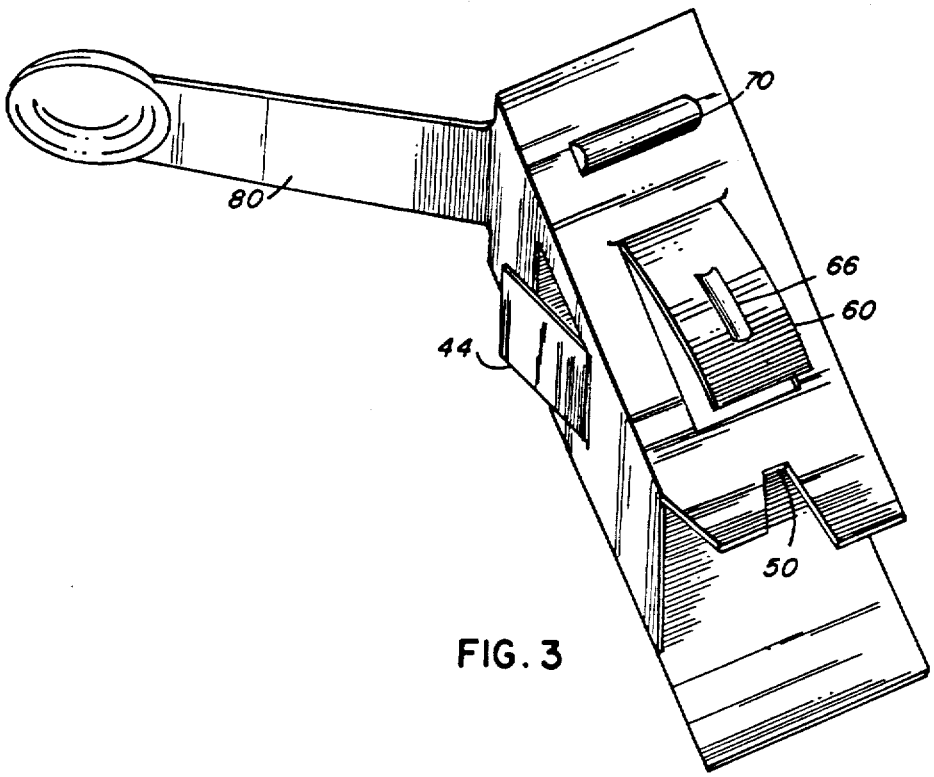
Figure 4:
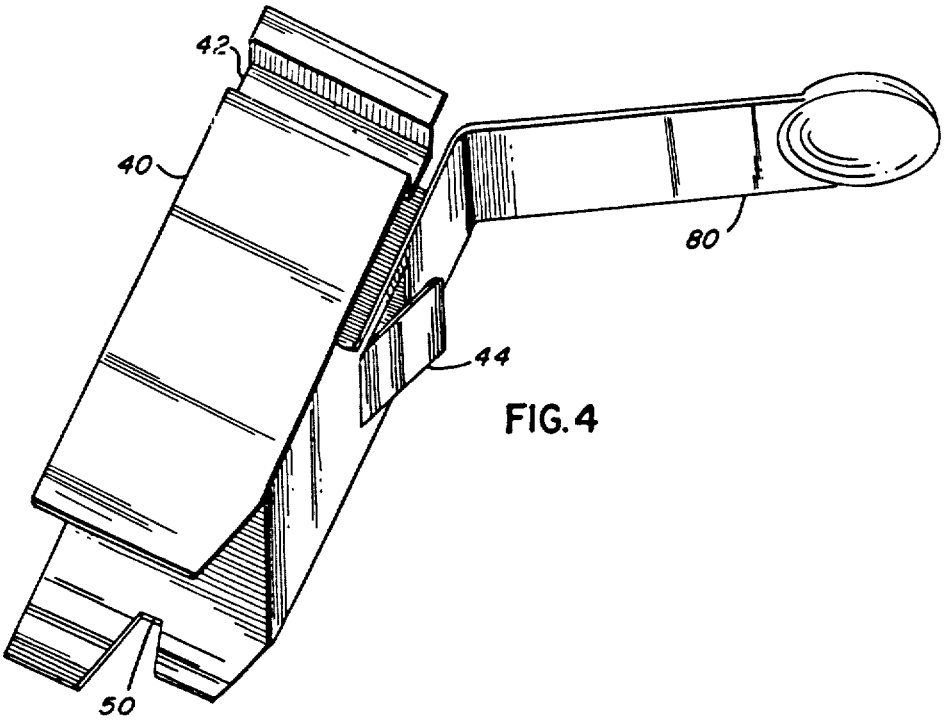

Enclosing a portion of the envelope extension 18 is a clip 40. FIG. 3 shows a first perspective view of a preferred embodiment of a clip. The clip 40 has a conductive body with an interior surface and an exterior surface. The interior surface is designed to receive and couple with the envelope extension. The particular embodiment shown in FIGS. 3 and 4 includes an attachment point designed for close fit with the indentation 26. The exterior surface is designed to receive the lead for mechanical coupling and electrical connection to the clip. The exterior surface is further designed to couple with the base, or other support structure In a particular embodiment, as shown in FIGS. 3 and 4, the clip 40 has the overall form of three sides folded at right angles to form an open ended box. The open end of the box is designed to clip over and mate with a portion of the envelope extension 18.

Figure 2:
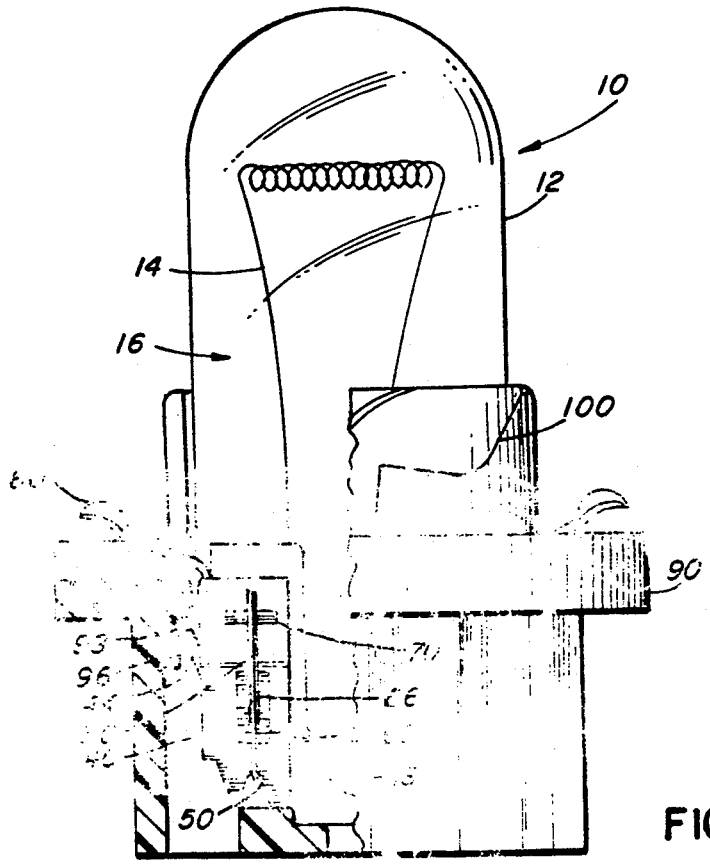
FIG. 2 shows a front view, partially cut away, of a preferred embodiment of a wedge lamp and clip Positioned in a base.

The clip 40 may be conveniently formed from a resilient and conductive metal, such as a copper alloy, allowing the envelope extension 18 to be pinched between two sides of the box shape. Only one lamp lead 30 and clip 40, are shown in FIG. 1, and FIG. 2, but the preferred embodiment uses two clips for a two lead lamp, one clip for each lead.

The clip 40 performs two general functions, mechanical linkage between the envelope and base or support; and electrical connection between the lead and an exterior source. In the preferred embodiment, the interior sides of the clip 40 fit with the envelope extension 18 while the exterior sides of the clip 40 fit with a support to accommodate the envelope extension to the support. The envelope 12 mechanically links to the clip 40 and the clip 40 links to a support, which may be a base 90, such as a nylon twist lock. Alternatively, the envelope 12 and clip 40 may be joined directly to any formed piece having an appropriately shaped receptacle. For example, the envelope 12 and clip 40 may be inserted directly into a circuit board or similar piece having an appropriately shaped receiving cavity. No intermediate base 90 is then necessary.

To mechanically couple with the envelope 12 at attachment point 26, the clip 40 includes a trapping mechanism. The preferred trapping mechanism 42 consists of a portion along the interior surface of the clip 40 complementary with the attachment point of the envelope extension 18. By abutting the envelope extension 18 with the complementary interior portion of the clip, the envelope 12 is then firmly linked to the clip 40 when either the envelope 12 or the clip 40 moves transverse to the mated portions, or more specific to the preferred embodiment, in the insertion 20 or withdrawal direction. Pinching the envelope extension lB on one side at the attachment point 26, by the trapping mechanism 42 and on the other side of the envelope extension 18 by another interior portion of the clip 40, conveniently allows the clip to be correctly positioned during assembly and final use. The clip 40 shown includes a crimped protrusion fitted to the envelope extension 18 in the indentation 26 as a trapping mechanism 42 to securely link the envelope 12 and clip 40.

To couple the clip 40 to either a base 90 or a general support, the preferred clip 40 further includes a locking mechanism as a motion stopper. Perhaps the simplest locking mechanism is a spring tab 44 allowing insertion of the clip 40 along a wall section of a base 90 or general support which limits withdrawal after insertion. The location of the trapping mechanism 42 with respect to the spring tab 44 may have the additional attribute of deflecting forces acting on either the envelope or the base from detrimentally working on the lead 30. By closely coupling the envelope extension 18 to the clip 40, and the clip 40 to the base 90 or other support, forces applied to the lamp 10 or the base 90 are transfered directly through the clip 40 and bypass the lead 30, the lead coupling, and the lead contacts. In the preferred embodiment, the close couplings made by the trapping mechanism 42 and the spring tab 44 limit detrimental twisting, pulling or other mechanical working of the electrical portions of the clip 40. FIG. 4 shows a perspective view of a preferred embodiment of a clip with the mechanically close relationship between the trapping mechanism 42 and the spring tab 44. On a side of the clip 40, adjacent the trapping mechanism 42 is the spring tab 44. The remaining portion of the clip 40 is then available for relatively force free support of the remaining aspects of the clip 40.

The clip 40 also makes a secure electrical connection to the lead 30 and thereby to the enclosed lighting mechanisms. It is a particular feature of the present design that a folded back portion of the lead 30 is attached to the exterior of the clip 40. Exterior attachment of the lead 30 to the clip 40 has been found to be particularly convenient and useful in the overall design. FIGS. 1, and 2 show three electrical contact points between the lead 30 and the exterior of clip 40.

A first connection point may be a slot 50. The slot 50 in the preferred embodiment is positioned at a distance from the trapping mechanism 42 and spring tab 44 to provide some flexibility between the mechanical and electrical connection points of the clip 40. The slot 50 includes an opening slightly larger than the diameter of the lead 30, so by pressing the electrical lead 30 into the slot, the slot 50 mechanically traps the lead 30 but limits most twisting or other potentially displacing motions from affecting the lead position during insertion or removal of the lamp. In the preferred embodiment, the lead 30 is folded for a portion of its length, over the exterior of the clip 40. The lead 30 passes through the slot 50 area allowing a flexible length along the lead 30 between exit point from the envelope extension 18 and the slot 50. The flexible length helps prevent work failure of the lead 30 between the envelope extension 18 and clip 40. The lead 30 is drawn tightly against the insertion facing slot 50 during insertion. The spring tab 44 holds the clip 40 in position, thereby continuing the tight contact between the lead 30 and slot 50. In an alternative embodiment, the slot 50 may be formed to have a slightly smaller opening than the diameter of the lead 30, so by pressing the electrical lead 30 into the slightly smaller slot 50, the slot 50 is spread mechanically to tightly trap the lead 30.

Operating laterally on the lead 30 may be a second electrical connection, a spring contact 60. The spring contact 60 may be conveniently formed as a resilient tab adjacent the lead 30. The lead 30 in one embodiment is tightly drawn across the spring contact 60 to slightly compress the spring contact 60. The spring contact 60 then makes a flexible contact with the lead 30. In another embodiment, the spring contact 60 may coact with a wall portion of a base 90 or other insertion receptacle. Insertion of the envelope 12 and clip 40 in a base 90 or receptacle, then forces the lead 30 into spring loaded contact with the spring contact 60.

The spring contact 60, in the preferred embodiment has an additional feature of a lead positioner Parallel with the lead 30, aligned with slot 50 and centrally located on the spring contact 60 may be a slight indentation or dent 66 to prevent the lead 30 from rolling or sliding off the spring contact 60. The dent 66 has a depth less than the lead diameter. In the preferred embodiment, the lead 30, is then folded back across the exterior of the clip 40, inserted in the slot 50, positioned across the spring contact 60, and located in the dent 66. FIG. 3 shows perspective view of a preferred embodiment of a clip, including the slot 50, spring contact 60, and dent 66. The lead positioning dent 66 may be a notch, tab, or other locating means.

A third electrical contact may be made by securely fixing of the lead 30 to the clip 40 at an anchor point. Any appropriate conductive mechanical anchoring of the lead 30 to the exterior of the clip 40 may be used. Applicants prefer welding the lead 30 to the clip 40. The preferred embodiment of the anchor point includes a weld point 70 in the form of a small bump on the clip 40 surface. The weld point 70 is conveniently inline with the slot 50, spring contact 60 and dent 66. The mechanical anchor limits working of the lead 30 in the electrical contacts, and helps assure a tight contact between the lead 30 and the clip 40. Failure of two of the three contact points may occur while secure conduction is still made by the remaining contact.

The preferred embodiment of the clip 40 also includes an exterior contact point for conductive connection between the clip 40 and an outside electric source. The functional relation is for the lead 30 contact points such as the slot 50, spring contact 60 and weld point 70, to be in electric communication with the exterior contact point. FIG. 2 shows a front view, partially cut away, of a preferred embodiment of a wedge lamp and clip 40 positioned in a base 90. FIG. 2 shows the lead 30 and the three contact points in mutual connection through the one piece conductive clip 40. The clip 40 includes a resilient arm 80 as an exterior Contact point extending from the clip 40 in the region of the trapping mechanism 42 and spring tab 44. The resilient arm 80 may be designed to be compressed into contact with an outside electric source when the lamp 10 is positioned. Alternatively the extended arm 80 may be soldered to for electric connection.

An optional component in the present lamp design is a base 90. The base 90 is composed of an insulating material and includes an opening sized and positioned to receive a portion of the envelope extension 18, the lead 30 and clip 40. In the preferred embodiment the base 90 opening includes a first wall portion 92 and second wall portion 94 approximately parallel, and separated by a distance allowing insertion of the envelope extension 18, lead 30 and clip 40. The wall spacing is close to assure contact between the trapping mechanism 42 and the adjacent first wall portion 92 on one side, and between the lead 30 in the area of the spring contact 60 and the adjacent second wall portion 94 on the other side. The trapping mechanism 42 is then forced into close relation to the indentation 26 to assure mechanical linkage, while simultaneously pressing the lead 30 to the spring contact 60 to assure electric contact. Additionally, the base 90 opening includes features to coact with the spring tab 44, which in the Preferred embodiment comprises a wall section 96 close to or even compressing slightly the spring tab 44, and a lip portion 98 adjacent the clip 40 and exterior to the spring tab 44 in the withdrawal direction when the tab is finally positioned. The spring tab 44 then catches on lip portion 98 during withdrawal to stop further withdrawal. The base 90 may further include other appropriate features for coupling of the envelope 12 and clip 40 to the base 90, and base 90 to a receptacle such as guide keys, positioning and locking features as are generally known in the art. Alternatively, the spring tab 44 may be formed in the base wall 92 to coact with a lip or similar portion formed in the clip 40. Similarly, the spring portion of the spring contact may be fashioned in the base wall 94, as for example by a spring tab. The base 90 shown includes twist lock camming surfaces 100.

In a working example, the clip length along the envelope extension was about 6 mm, the clip width including the spring contact height was about 3 mm, and the extended arm was about 4.5 mm.

The disclosed operating conditions, dimensions, configurations and embodiments are as examples only, and other suitable configurations and relations may be used to implement the invention.

While there have been shown and described what are at present considered to be the preferred embodiments of the invention, it will be apparent to those skilled in the art that various changes and modifications can be made herein without departing from the scope of the invention defined by the appended claims.

What is claimed is:

1. An electrically conductive clip electrically connecting an electrical lead extending from a lamp envelope to an electric source comprising: an electrically conductive clip body having a) interior and exterior portions, b) coupling means along the interior portion coacting with the envelope to fixedly position the clip with respect to the envelope, c) means for mechanically coupling a portion of the electrical lead to the exterior portion of the clip, comprising a spring contact for making a lateral tensioning compression contact between the lead and the clip, d) means for electrically connecting the lead to the clip, and e) means for electrically connecting the clip to the electric source.

2. The clip apparatus of claim 1, wherein the spring contact comprises a spring tab protruding from the exterior surface of the clip adjacent the lead for applying a lateral tensioning force to the lead.

3. The clip apparatus of claim 2, wherein the spring contact further includes locating means to position the lead with respect to the spring contact.

4. The clip apparatus of claim 3, wherein the locating means comprises a depression in the spring contact having smaller size than the adjacent lead.

5. An electrically conductive clip electrically connecting an electrical lead extending from a lamp envelope to an electric source comprising: an electrically conductive clip body having a) interior and exterior portions, b) coupling means along the interior portion coacting with the envelope to fixedly position the clip with respect to the envelope, c) means for mechanically coupling a portion of the electrical lead to the exterior portion of the clip, d) means for electrically connecting the lead to the clip, and e) means for electrically connecting the clip to the electric source, wherein the means for mechanically coupling and electrically connecting the lead to the clip comprise in sequence:

a) a lead trapping contact means for trapping and electrically contacting a portion of an electric lead, b) a spring contact means for applying a lateral tensioned contact to the electric lead, and c) a conductive lead anchoring means for securely joining the electric lead to the exterior of the clip.

6. An electrically conductive lip for positioning a lamp envelope with respect to a support and electrically connecting an electrical lead extending from the lamp envelope comprising: an electrically conductive clip having a) interior and exterior portions,
b) coupling means along the interior portion for coacting with the envelope to fixedly position the clip with respect to the envelope,
c) a slot sized to trap and electrically contact the lead,
d) a spring contact on the exterior surface of the clip for applying a lateral tensioning force to the lead,
e) a weldment electrically and mechanically joining a portion of the lead to the exterior portion of the clip, and
f) means for electrically connecting the clip to the electric source.

7. A lamp and clip comprising:

i) a light transmissive envelope enclosing means for producing light by electric energy, having an insertion direction, and coupling means for establishing a coupled relation to the envelope;
ii) an electric lead to power the light producing means, passing from the envelope; and
iii) an electrically conductive clip, having
  a) interior and exterior portions,
  b) coupling means along the interior portion coacting with the envelope coupling means to fixedly position the clip with respect to the envelope at least in the insertion and withdrawal directions,
  c) means for mechanically coupling a portion of the lead to the exterior of the clip,
  d) means for electrically connecting the lead to the clip, and
  e) means for electrically connecting the clip to the electric source, wherein the means for mechanically coupling and electrically connecting the lead comprise a spring contact making a lateral tensioning compression contact between the lead and the clip.

8. The lamp and clip apparatus of claim 7, wherein the spring contact comprises a spring tab for applying a lateral tensioning force to the lead.

9. The lamp and clip apparatus of claim 8, wherein the spring contact further includes locating means to position the lead with respect to the spring contact.

10. The lamp and clip apparatus of claim 9, wherein the locating means comprises a depression in the spring contact having smaller size than the adjacent lead.

11. A lamp and clip comprising:

i) a light transmissive envelope enclosing means for producing light by electric energy, having an insertion direction, and coupling means for establishing a coupled relation to the envelope;
ii) an electric lead to power the light producing means, passing from the envelope; and
iii) an electrically conductive clip, having
  a) interior and exterior portions,
  b) coupling means along the interior portion coacting with the envelope coupling means to fixedly position the clip with respect to the envelope at least in the insertion and withdrawal directions,
  c) means for mechanically coupling a portion of the lead to the exterior of the clip,
  d) means for electrically connecting the lead to the clip, and
  e) means for electrically connecting the clip to the electric source, wherein the means for mechanically coupling and electrically connecting the lead to the clip comprises in sequence a) a lead trapping contact means for trapping and electrically contacting a portion of an electric lead,
  b) a spring contact means for applying a lateral tensioned contact to the electric lead, and
  c) a conductive lead anchoring means for securely joining the electric lead to the exterior of the clip.

12. The lamp and clip apparatus of claim 11 wherein the means for making an electrical connection to an exterior electric source comprises an extended arm.

13. The lamp and clip apparatus of claim 12 wherein the extended arm for making an electrical connection is a resilient arm for compression contact with the exterior electric source.

14. The lamp and clip apparatus of claim 11, further including means for limiting withdrawal of the lamp and clip from a support for the lamp and clip.

15. The lamp and clip apparatus of claim 14, wherein the withdrawal limitation means comprises a spring biased portion compressible on passing along a wall portion of a support for the lamp and clip in an insertion direction and locking with a wall portion of the support on complete insertion to limit withdrawal.

16. A lamp comprising:

i) a light transmissive envelope enclosing means for producing light by electric energy, having an insertion direction, a formed extension of the envelope including means for establishing a coupling relation to the envelope;
ii) an electric lead extending from the envelope extension to power the light producing means;
iii) an electrically conductive clip coupled to the envelope extension, having
  a) interior and exterior portions,
  b) envelope coupling means along the interior portion to fixedly position the clip with respect to the envelope at least in the insertion and withdrawal directions,
  c) a lead trapping means for electrically contacting and trapping a portion of the electric lead,
  d) a spring contact means on the exterior surface of the clip for applying a lateral tensioning force to the lead,
  e) a conductive lead anchoring means for securely joining the electric lead to the exterior of the clip, and
  f) a withdrawal limitation means for resisting withdrawal of the clip after insertion; and
iv) a base means including a passage sized and positioned to receive a portion of the envelope extension and attached clip, and further having a wall portion in the passage adjacent lead in the area of the spring contact means to press the lead against the spring contact means and thereby induce a compression force between the spring contact means across the lead to the first wall portion, and having a second wall portion adjacent and coacting with the withdrawal limitation means to limit withdrawal after insertion of the envelop and clip.

17. The apparatus in claim 16, wherein the base further includes locking means for coupling the base to a support.

18. The apparatus in claim 16, wherein the base further includes a third wall portion adjacent and coacting with the envelope coupling means to limit decoupling of the coupling means from the envelope thereby assisting the action of the coupling means.

* * * * *

UNITED STATES PATENT AND TRADEMARK OFFICE

CERTIFICATE OF CORRECTION

PATENT NO. : 5,018,992

DATED : May 28, 1991

INVENTOR(S) : Bergin et al

It is certified that error appears in the above-identified patent and that said Letters Patent is hereby corrected as shown below:

The title page should be deleted to appear as per attached title page.

The sheets of drawing consisting of Figs. 1-4, should be deleted to appear as per attached pages.

Signed and Sealed this

Twentieth Day of October, 1992

*Attest:*

DOUGLAS B. COMER

*Attesting Officer*

*Acting Commissioner of Patents and Trademarks*

United States Patent [19]

Bergin et al.

[11] Patent Number: 5,018,992

[45] Date of Patent: May 28, 1991

[54] WEDGE LAMP AND CLIP

[75] Inventors: John A. Bergin, Hancock; Roger A. Racette, Hillsboro, both of N.H.

[73] Assignee: GTE Products Corporation, Danvers, Mass.

[21] Appl. No.: 197,014

[22] Filed: May 20, 1988

[51] Int. Cl.[5] ..... H01R 33/09

[52] U.S. Cl. ..... 439/699; 313/318

[58] Field of Search ..... 439/619, 699, 611, 612; 313/318

[56] References Cited

U.S. PATENT DOCUMENTS

| | | | |
|---|---|---|---|
| 1,721,207 | 7/1929 | Cunningham | 439/458 |
| 2,937,308 | 5/1960 | Howles et al. | 313/315 |
| 3,573,534 | 8/1971 | Leighton | 313/318 |
| 3,783,437 | 1/1974 | Graff et al. | 439/619 |
| 3,936,131 | 2/1976 | Durand | 439/699 |
| 3,986,068 | 10/1976 | Albrecht | 313/318 |
| 4,052,638 | 10/1977 | Love et al. | 313/318 |
| 4,074,929 | 2/1978 | Krider | 439/676 |
| 4,114,972 | 9/1978 | Kraus et al. | 439/375 |
| 4,152,622 | 5/1979 | Fitzgerald | 313/318 |
| 4,181,390 | 1/1980 | Aizawa | 439/375 |
| 4,316,240 | 2/1982 | Pitkjaan et al. | 362/267 |
| 4,318,158 | 3/1982 | Livermore et al. | 362/29 |
| 4,365,396 | 12/1982 | Baba et al. | 439/699 |
| 4,418,973 | 12/1983 | Smetana | 439/699 |
| 4,468,585 | 8/1984 | Beyland et al. | 313/318 |
| 4,473,770 | 9/1984 | Baba et al. | 313/318 |
| 4,593,958 | 6/1986 | Baba | 439/699 |
| 4,595,859 | 6/1986 | Steiner et al. | 313/318 |
| 4,603,278 | 7/1986 | Devir et al. | 313/318 |
| 4,631,651 | 12/1986 | Bergin et al. | 362/267 |
| 4,724,353 | 2/1988 | Devir | 313/318 |

FOREIGN PATENT DOCUMENTS

| | | | |
|---|---|---|---|
| 3020309 | 12/1981 | Fed. Rep. of Germany | 313/318 |
| 1475752 | 9/1969 | France . | |

*Primary Examiner*—Neil Abrams

*Attorney, Agent, or Firm*—William E. Meyer

[57] ABSTRACT

A wedge lamp and clip having exterior means for making electric connections to a lamp lead, and having pinning means for securely locating the lamp and clip in a base are described. By bringing the lamp lead out and folding it back over the lamp clip, the clip may directly and securely mate to the envelope extension, and multiple secure electrical and mechanical contacts may be made between the clip and the lamp lead. By making the clip conductive, the electric connection need not be made directly to the lamp lead, but may be made indirectly through the conductive clip. Mechanical stress between the lamp envelope and any support may also be mediated by the clip.

18 Claims, 2 Drawing Sheets

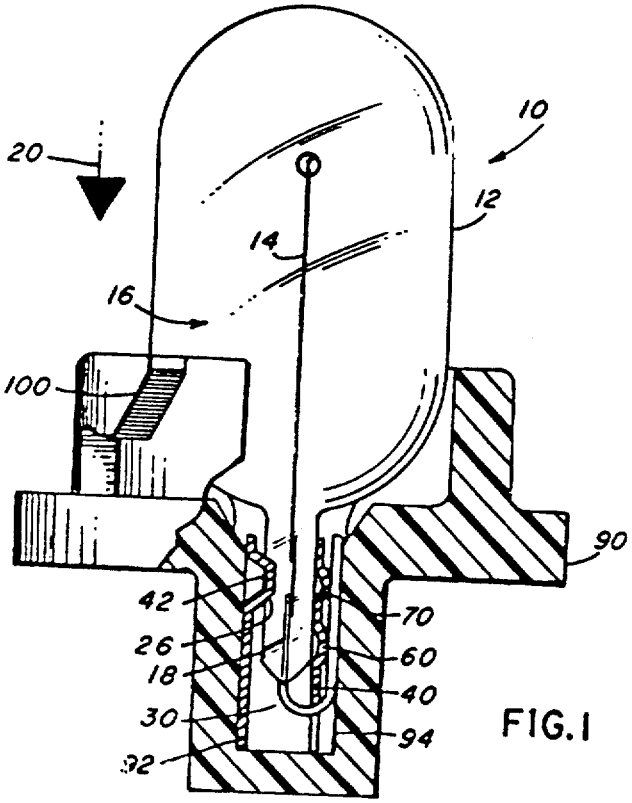

FIG. 1